US005743194A

United States Patent [19]

Ziegeler

[11] Patent Number: 5,743,194

[45] Date of Patent: Apr. 28, 1998

[54] REMOVABLE WORKING SURFACE FOR A COMMON DESK DRAWER

[76] Inventor: Wesley B. Ziegeler, 104 Grass St., Waveland, Miss. 39576

[21] Appl. No.: 807,759

[22] Filed: Feb. 27, 1997

[51] Int. Cl.[6] ..... A47B 47/00

[52] U.S. Cl. ..... 108/157.13; 312/277

[58] Field of Search ..... 312/277, 282, 312/310, 330.1, 194; 108/159, 157, 90, 157.13, 157.1, 157.15

[56] References Cited

U.S. PATENT DOCUMENTS

| | | | |
|---|---|---|---|
| 327,413 | 9/1885 | Rohrbach | 108/157 |
| 796,855 | 8/1905 | Nurick | 108/90 |
| 900,247 | 10/1908 | Williams | 108/157 |
| 5,248,192 | 9/1993 | Tazzia | 312/194 |
| 5,443,311 | 8/1995 | Kadlecek et al. | 108/90 |

*Primary Examiner*—Peter M. Cuomo
*Assistant Examiner*—Gerald A. Anderson

[57] ABSTRACT

A removable working surface for a common desk drawer which is a rectangular block of width and length enough to fit atop most desk drawers and thick enough to be sturdy yet light. The bottom surface has two smaller blocks which are nearly as long and thick as the surface, but a fraction of the width. The blocks can be adjusted side to side to fit the inner side walls of a desk drawer, preventing shifting. To adjust the blocks, the screws attaching the blocks are loosened, the blocks moved to the desired position, and the screws re-tightened. Access to the drawer is still easy; simply lift the front of the surface, or remove it completely.

1 Claim, 1 Drawing Sheet

REMOVABLE WORKING SURFACE FOR A COMMON DESK DRAWER

BACKGROUND OF THE INVENTION

This invention relates to a removable working surface for a common desk drawer which allows most desk drawers to be used as a flat surface for extra desk space.

Desks provide a top working surface with drawers below that surface that can be used as storage space. Sometimes the top working surface does not provide enough space upon which to work satisfactorily. This is especially true in modern times when the increased use of computers and other electronic equipment take up valuable working space.

Some desks are designed with a built-in shelf above the top drawer which can be pulled out and used for extra work space. However, many desks do not include this feature. Prior add-on working surfaces have used desk drawers to create more work space; however, they are not designed to be easily removable, thereby eliminating the use of the drawer as storage space.

BRIEF SUMMARY OF THE INVENTION

This invention is directed to a removable work surface for a common desk drawer which may be installed into the drawer of most common desks. The purpose of the present invention is to provide, extra work space for desks by utilizing the built in drawers and make this added work space easy to lift to provide access to the drawer and easily removable if greater access to the drawer is necessary.

The removable work surface is a rectangular block made of any sturdy, solid material such as wood, metal, or plastic so that it may support relatively heavy objects such as electronic equipment, yet be lightweight enough to remove from the desk drawer easily. It will be long and wide enough to fit atop the drawers of most desks, and thick enough to be sufficiently sturdy. On the bottom side of the removable work surface, two smaller rectangular blocks of equal or slightly lesser length, approximately 1½ inches wide and approximately ¼ inch thick, are attached to the left and right sides running lengthwise. These two smaller blocks are attached by means of screws or winged-head screws. Each of the blocks have two precut elongated holes near each end running most of the width of the blocks to allow the blocks to be shifted to the left or right. Shifting the blocks allows the removable work surface to be put atop the drawer with the smaller blocks fitted to the inside of the desk drawer so that it will not slide or fall into the desk drawer. Once a placement of the blocks is found to be satisfactory, the screws may be tightened to prevent any unwanted shifting.

DETAILED DESCRIPTION OF THE INVENTION

Figure 1:
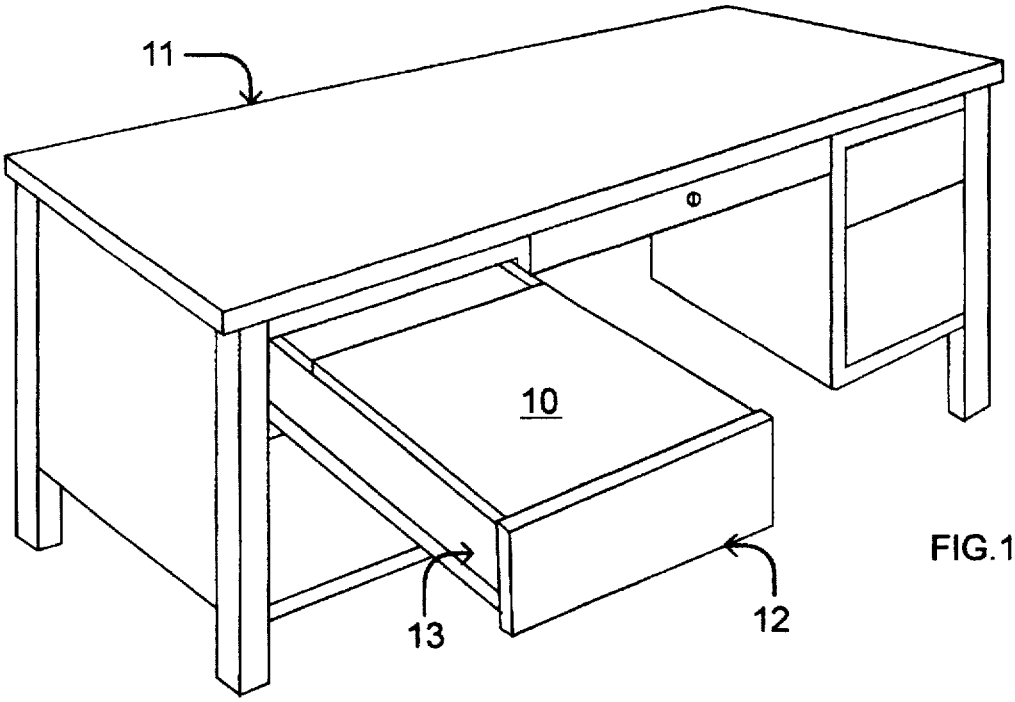
FIG. 1 is a perspective view of the removable working surface of the invention used to increase usable desk space. It is shown sitting on a desk drawer, having been adjusted to fit properly.
Figure 2:
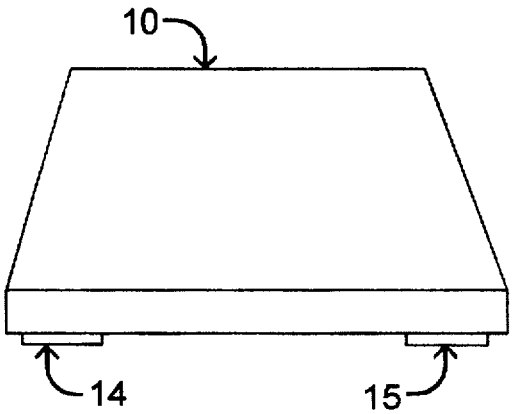
FIG. 2 is a perspective view of the top and front surfaces of the invention.
Figure 3:
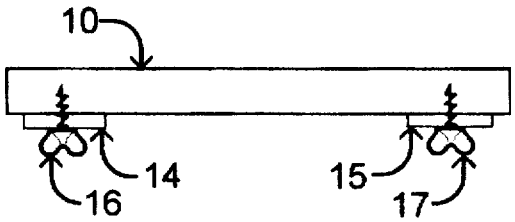
FIG. 3 is an end view, orthogonal to the front, showing the two blocks and the screws holding the blocks to the surface.
Figure 4:
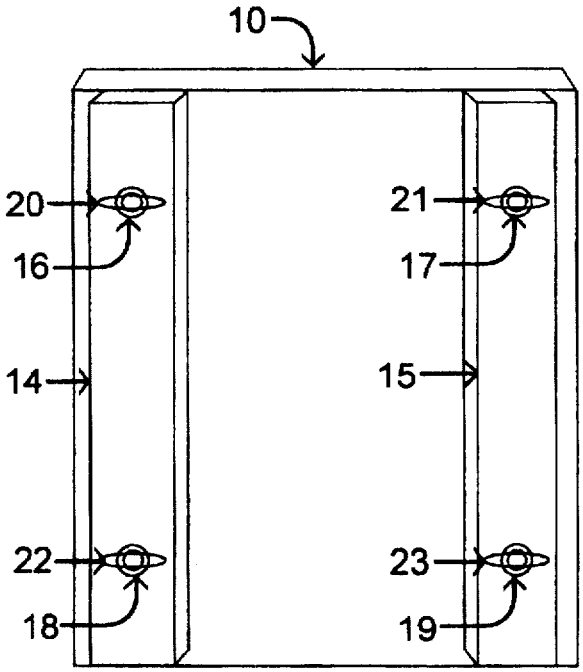
FIG. 4 is a perspective view of the bottom and front surfaces with the blocks, screws, and pre-made, elongated holes in the components.

Referring to FIG. 1, the removable working surface indicated generally at 10, fits onto desk drawer 12 which is part of desk 11.

The two blocks 14 and 15, which are the same in structure and function, are shown in FIG.'s 2, 3 and 4. They are attached to removable working surface 10 by screws 16, 17, 18, and 19, which are all the same in structure and function. Precut, elongated holes 20, 21, 22, and 23, all the same in structure and function, allow screws 16, 17, 18, and 19 to be loosened so that blocks 14 and 15 can be moved side to side. The outer sides of blocks 14 and 15 fit against the inner left and right sides of the drawer; one side of the drawer in which the aforementioned blocks are fit against is illustrated as 13 in FIG. 1.

While there has been shown and described a preferred embodiment of the removable working surface for a common desk drawer of this invention, it is understood that changes in structure, materials, sizes, and shapes can be made by those skilled in the art without departing from the invention. The invention is defined in the following claims.

I claim:

1. A removable working surface supported by a desk drawer comprising: a drawer having two side walls, a rear wall and a front wall, each wall having a top edge and the front wall having a height greater than the height of the side walls, one rectangular surface supported at least by the side wall top edges, two adjustable, parallel members fastened to a bottom of the rectangular surface, said members having a length less than the distance between said rear wall and said front wall and a width less than half of the distance between the drawer side walls, said members adjustable outwardly to engage inside surfaces of the side walls to secure the rectangular surface.

* * * * *